US006099387A

United States Patent [19]

Gilmer et al.

[11] Patent Number: 6,099,387

[45] Date of Patent: Aug. 8, 2000

[54] CMP OF A CIRCLET WAFER USING DISC-LIKE BRAKE POLISH PADS

[75] Inventors: Mark C. Gilmer, Austin; Mark I. Gardner, Cedar Creek, both of Tex.

[73] Assignee: Advanced Micro Devices, Inc., Sunnyvale, Calif.

[21] Appl. No.: 09/097,607

[22] Filed: Jun. 15, 1998

[51] Int. Cl.[7] ..... B24B 5/00; B24B 49/00

[52] U.S. Cl. ..... 451/10; 451/41; 451/268; 451/269; 451/317; 451/324; 451/385; 451/398

[58] Field of Search ..... 451/5, 8, 10, 36, 451/41, 312, 313, 317, 319, 324, 364, 385, 398, 446, 269, 268, 44

[56] References Cited

U.S. PATENT DOCUMENTS

| | | | |
|---|---|---|---|
| 3,619,952 | 11/1971 | Leming et al. . | |
| 3,691,878 | 9/1972 | Mitchell . | |
| 3,721,046 | 3/1973 | Dunn . | |
| 4,262,452 | 4/1981 | Lopez . | |
| 4,361,988 | 12/1982 | Gramlich . | |
| 4,586,296 | 5/1986 | Saunders . | |
| 5,121,572 | 6/1992 | Hilscher . | |
| 5,133,155 | 7/1992 | Schwar . | |
| 5,152,104 | 10/1992 | Wood et al. . | |
| 5,645,472 | 7/1997 | Nagahashi et al. | 451/261 |

OTHER PUBLICATIONS

Stanley Wolf and Richard N. Tauber, *Silicon Processing for the VLSI Era*, vol. 2—Process Integration; pp. 201–207, 222–227, and 238–239; 1990.

Stanley Wolf and Richard N. Tauber, *Silicon Processing for the VLSI Era*, vol. 3—The Submicron MOSFET; p. 373; 1995.

*Primary Examiner*—Timothy V. Eley
*Attorney, Agent, or Firm*—Timothy M. Honeycutt

[57] ABSTRACT

Apparatus and method for polishing one or both sides of a semiconductor wafer that has a central opening are provided. In one aspect, the apparatus includes a mandrel for holding the wafer and a motor coupled to the mandrel that is operable to rotate the mandrel. A first polisher assembly is provide that has a first polish pad for polishing the first side of the wafer and a second polish pad for polishing the second side of the wafer, and first means for moving the first and second polish pads into and out of engagement with the first and second sides of the wafer. According to the method, a semiconductor wafer is coupled to a rotatable mandrel and a polishing mixture is dispensed on one or both of the sides of the semiconductor wafer. A first polish pad is brought into contact with the first side of the semiconductor wafer and a second polish pad is brought into contact with the second side of the semiconductor wafer such that the first and second polish pads are positioned in opposition. The mandrel is rotated to spin the wafer.

35 Claims, 7 Drawing Sheets

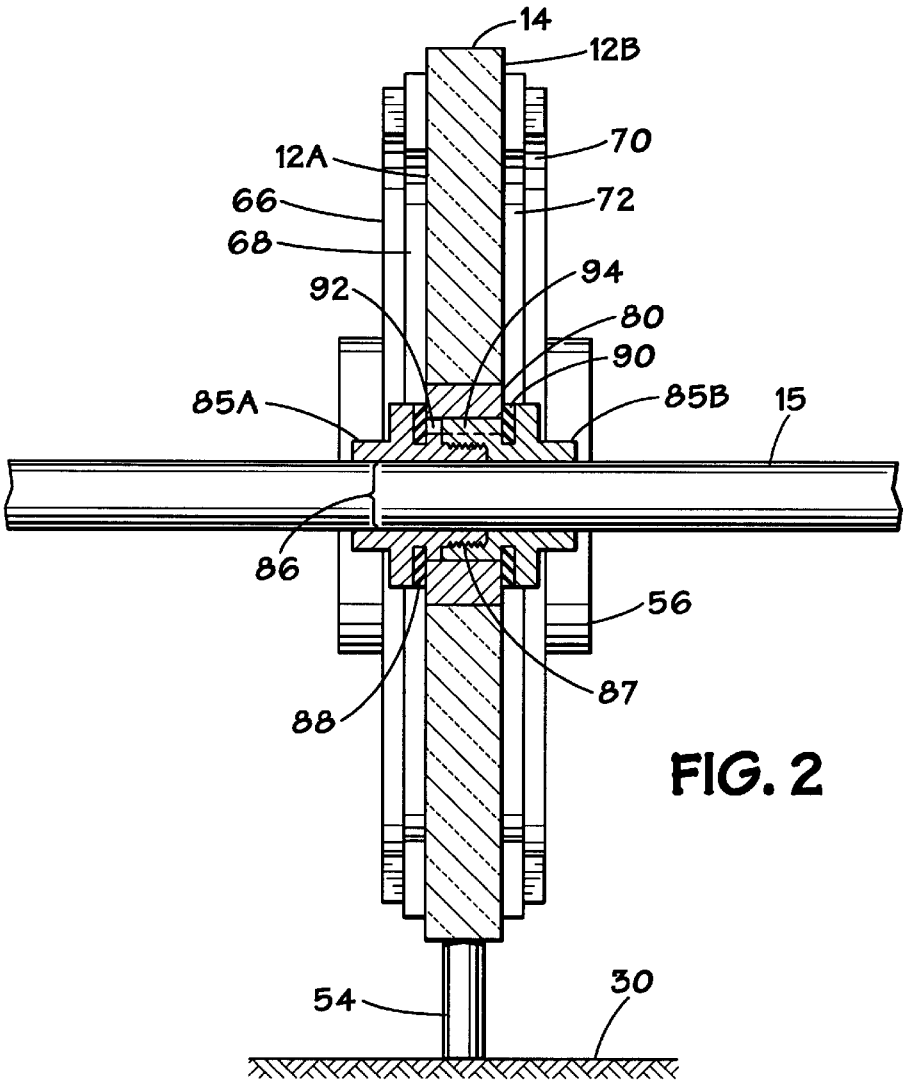
FIG. 2
FIG. 3
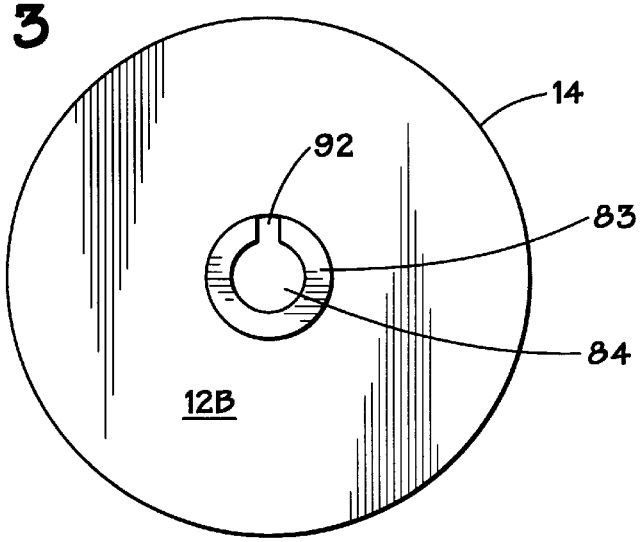

CM P OF A CIRCLET WAFER USING DISC-LIKE BRAKE POLISH PADS

BACKGROUND OF THE INVENTION

1. Field of the Invention

This invention relates generally to semiconductor processing, and more particularly to apparatus method and for polishing one or both sides of a semiconductor wafer.

2. Description of the Related Art

Modem integrated circuits routinely incorporate hundreds of thousands or millions of active devices on a single substrate. Early in the fabrication flow of such circuits, each of the active devices is normally electrically isolated from other active devices. However, in the latter stages of a typical process flow, many of the active devices must be electrically interconnected to implement the desired circuit function for the integrated circuit. In early integrated circuits incorporating a few hundred or thousand devices, the interconnection of the devices was routinely accomplished via a single interconnect layer. However, modem integrated circuits almost invariably require more than one level of interconnect, and often four or more. Without them, many modem integrated circuits would otherwise require much larger chip areas, and often long distance interconnect paths, resulting in large RC products and unacceptably large propagation delays.

The introduction of multi-level interconnect structures introduced a new set of problems related to topography. An interlevel dielectric layer is normally required between each interconnect level. As the number of conductor and interlevel dielectric layers in a given technology is increased, the stacking of these additional layers on top of one another produces a more and more rugged topography. Without suitable planarization of the interlevel dielectric layers, microscopic canyons can form, creating topography conditions that may eventually reduce the yield of circuits to an unacceptable level. Some of these undesirable conditions include poor step coverage of conductor lines, conductor stringers left behind following anisotropic etching, and an artificial degradation of the maximum resolution of a given photolithographic patterning tool. If the topography of a given layer of an integrated circuit includes steps that are larger than a particular maximum value, it may not be possible to pattern features in the layer to the maximum resolution of the particular optical lithography tool.

Planarization of interlevel dielectrics became commonplace early in multi-level interconnect processing. In more recent years, planarization techniques have also become an important component of other phases of semiconductor fabrication. For example, shallow trench isolation structures are commonly fabricated by forming a trench network in a substrate and blanketing the substrate with a trench isolation material. The blanket layer of trench isolation material is then planarized down to the substrate, leaving only the preformed trenches filled with the isolation material. Similarly, local interconnect structures of tungsten or polysilicon are routinely planarized in more modem processes.

Etchback planarization has been a widely used planarization technique for a number of years. In etchback planarization processing, the interlevel dielectric layer is etched back to a desired final thickness, commonly by plasma or reactive ion etching. In some processes, the etchback is carried out through the use of a sacrificial layer that is deposited on the interlevel dielectric layer prior to the etchback. Barrier masks are often incorporated beneath the sacrificial layer. Tight process control is necessary for parameters such as the magnitude of the etch rate, the etch rate uniformity across the wafer, and endpoint detection in order to achieve a desired degree of planarity and final dielectric film thickness using etchback planarization. Adequate process control of all three of these and other parameters may prove elusive and result in poor yields.

Chemical-mechanical-polishing ("CMP") has augmented, and in many cases supplanted etchback planarization as a dominant planarization technique in integrated circuit processing. In conventional CMP processing, a wafer surface is lapped with the aid of a chemical slurry that consists of particulates of an abrasive dispersed in a liquid solvent. The slurry often includes a material that will chemically react with the wafer surface to form a compound that is more readily abraded than the original surface material. For example, a slurry used to polish $SiO_2$ may contain aluminum oxide particles that react with the $SiO_2$ to form aluminum silicate, which is more easily abraded than $SiO_2$.

Many conventional CMP machines include a flat, round, rotating polishing disk or pad that is disposed in a flat or horizontal orientation and is designed to polish several wafers simultaneously. The pad is often quite large, e.g., 36 inches in diameter or more, and is commonly made from a compliant material such as rubber. The wafers are secured to a horizontally disposed carrier via vacuum chucks. The carrier is lowered until the wafers contact the rotating polishing pad. A polishing slurry is interspersed between the wafer surface and the polishing pad. Acceptable planarity is highly dependent on uniform slurry dispersal.

There are several disadvantages associated with conventional CMP apparatus and processing. In CMP machines where the wafer is secured to a carrier by vacuum, excess vacuum force applied near the center of the wafer can lead to a phenomenon known as "dishing" where the wafer deforms slightly and takes on a dish-like profile. The problem may also arise, or be amplified where the wafer is not uniformly supported by the carrier, and as a result, undergoes deflection during polishing. In either case, poor planarity across the wafer surface may result.

Another source of nonuniform planarization is introduced by the nature of conventional compliant polish pads. Despite careful molding and shaping, nearly all new compliant polish pads have random variations in surface profile across their polish surfaces. Repeated use of the pad introduces additional variations into these polishing surfaces as a result of wear caused by the abrasive environment. These variations translate into undesirable variations in planarity of a polished wafer surface. To compensate for the anticipated variations in pad surface profile, many conventional machines deliberately introduce vibrations into the wafer. The goal is to attempt to cancel out the effects of the random nonuniformities by rapidly varying the pressure on the wafer. However, the vibration technique may not completely compensate for pad nonuniformity and may itself introduce additional variations in planarity across a given wafer. Another solution is to discard the pad after a set number of wafers. In many systems, the pad is replaced after every one hundred (100) wafers. This technique involves maintenance cost and downtime.

Inadequate slurry dispersion is another drawback associated with conventional CMP machines. As noted above, uniform dispersion of polishing slurry across the wafer surface is a key factor in achieving uniform planarity. However, many polishing slurries have relatively high viscosities and do not flow easily across a horizontal surface, particularly a large one such as a conventional polish pad.

Dispersion may be nonuniform and planarity may, in turn, be less than desired. To compensate for the otherwise poor flow characteristics of the slurry, the carrier is manipulated to increase the force pressing the wafers against the polish pad to levels that improve dispersion. In some systems, the force required may be 16 to 32 pounds or more. However, the high loading may amplify the effects of surface variations in the polish pad.

Another disadvantage associated with conventional CMP processing is the inability to efficiently polish both sides of a dual sided wafer. Conventional machines are configured to polish one side of a given wafer at a time. If polishing of both sides of a dual sided wafer is contemplated, one side of the wafer must first be polished in the machine, and then the wafer must be dropped from the carrier, flipped and repositioned in the carrier, and subjected to a second polishing operation. This may be a time consuming operation and requires very delicate handling of the wafer to avoid damaging the polished side while the unpolished side is processed.

The present invention is directed to overcoming or reducing the effects of one or more of the foregoing disadvantages.

SUMMARY OF THE INVENTION

In accordance with one aspect of the present invention, an apparatus for polishing a semiconductor wafer that has first and second sides and a central opening is provided. The apparatus includes a mandrel for holding the wafer and a motor coupled to the mandrel that is operable to rotate the mandrel. A first polisher assembly is provide that has a first polish pad for polishing the first side of the wafer and a second polish pad for polishing the second side of the wafer, and a first caliper assembly that has a first finger with a first end coupled to the first polish pad and a second end pivotably coupled to a member, and a second finger opposable to the first finger and that has a third end coupled to the second polish pad and a fourth end pivotably coupled to the member. A power screw is threadedly coupled to the first and second fingers and to a motor being operable to rotate the power screw clockwise and counterclockwise to pivot the first and second fingers.

In accordance with another aspect of the present invention, an apparatus for polishing a semiconductor wafer that has first and second sides and a central opening is provided. The apparatus includes a mandrel for holding the wafer and a motor coupled to the mandrel that is operable to rotate the mandrel. A first polisher assembly is provided that has a first polish pad for polishing the first side of the wafer and a first fluid driven cylinder coupled to the first polish pad for moving the first polish pad into and out of engagement with the first side of the wafer, and a second polish pad for polishing the second side of the wafer and a second fluid driven cylinder coupled to the second polish pad for moving the second polish pad into and out of engagement with the second side of the wafer, each of the first and second fluid driven cylinders has a housing, a first piston coupled to one of the first and second polish pads, a second piston, and a linear motor coupled to the second piston. The housing, the first piston and the second piston define a fluid chamber containing a volume of fluid whereby actuation of the motor moves the second piston axially to change the pressure in the fluid chamber and move the first piston.

In accordance with another aspect of the invention, an apparatus for polishing a semiconductor wafer that has first and second sides and a central opening is provided. The apparatus includes a mandrel for holding the wafer and a motor coupled to the mandrel that is operable to rotate the mandrel. A first polisher assembly is provided that has a housing that includes a first piston positioned in a first fluid chamber and coupled to a first polish pad for polishing the first side of the wafer and a second piston positioned in a second fluid chamber and coupled to a second polish pad for polishing the second side of the wafer. The first piston is operable to move the first polish pad into and out of engagement with the first side of the wafer and the second piston is operable to move the second polish pad into and out of engagement with the second side of the wafer.

In accordance with another aspect of the present invention, a method of polishing a semiconductor wafer having first and second sides is provided. The method includes the steps of coupling the wafer to a rotatable mandrel and dispensing a polishing mixture on one or both of the first and second sides of the semiconductor wafer. A first polish pad is brought into contact with the first side of the semiconductor wafer and a second polish pad is brought into contact with the second side of the semiconductor wafer such that the first and second polish pads are positioned in opposition. The mandrel is rotated to spin the wafer.

In accordance with another aspect of the present invention, an apparatus for polishing a semiconductor wafer that has first and second sides and a central opening is provided The apparatus includes a mandrel for holding the wafer and a coupling tat has a first half fixedly coupled to the mandrel. The first half has a first flange with a first elastomeric member coupled to the first flange to compliantly engage the first side of the semiconductor wafer. The coupling includes a second half with a second flange. The second flange has a second elastomeric member coupled to the second flange to compliantly engage the second side of the semiconductor wafer. A motor is coupled to the mandrel and is operable to rotate the mandrel. A first polisher assembly is provided that has a first arcuate polish pad for polishing the first side of the wafer and a second arcuate polish pad for polishing the second side of the wafer. A first means is provided for moving the first and second polish pads into and out of engagement with the first and second sides of the wafer.

BRIEF DESCRIPTION OF THE DRAWINGS

The foregoing and other advantages of the invention will become apparent upon reading the following detailed description and upon reference to the drawings in which:

FIG. 2 is a cross-sectional view of FIG. 1 taken at section 2—2;

FIG. 3 is an end view of the wafer shown in FIGS. 1 and 2;

DETAILED DESCRIPTION OF SPECIFIC EMBODIMENTS

Figure 1:
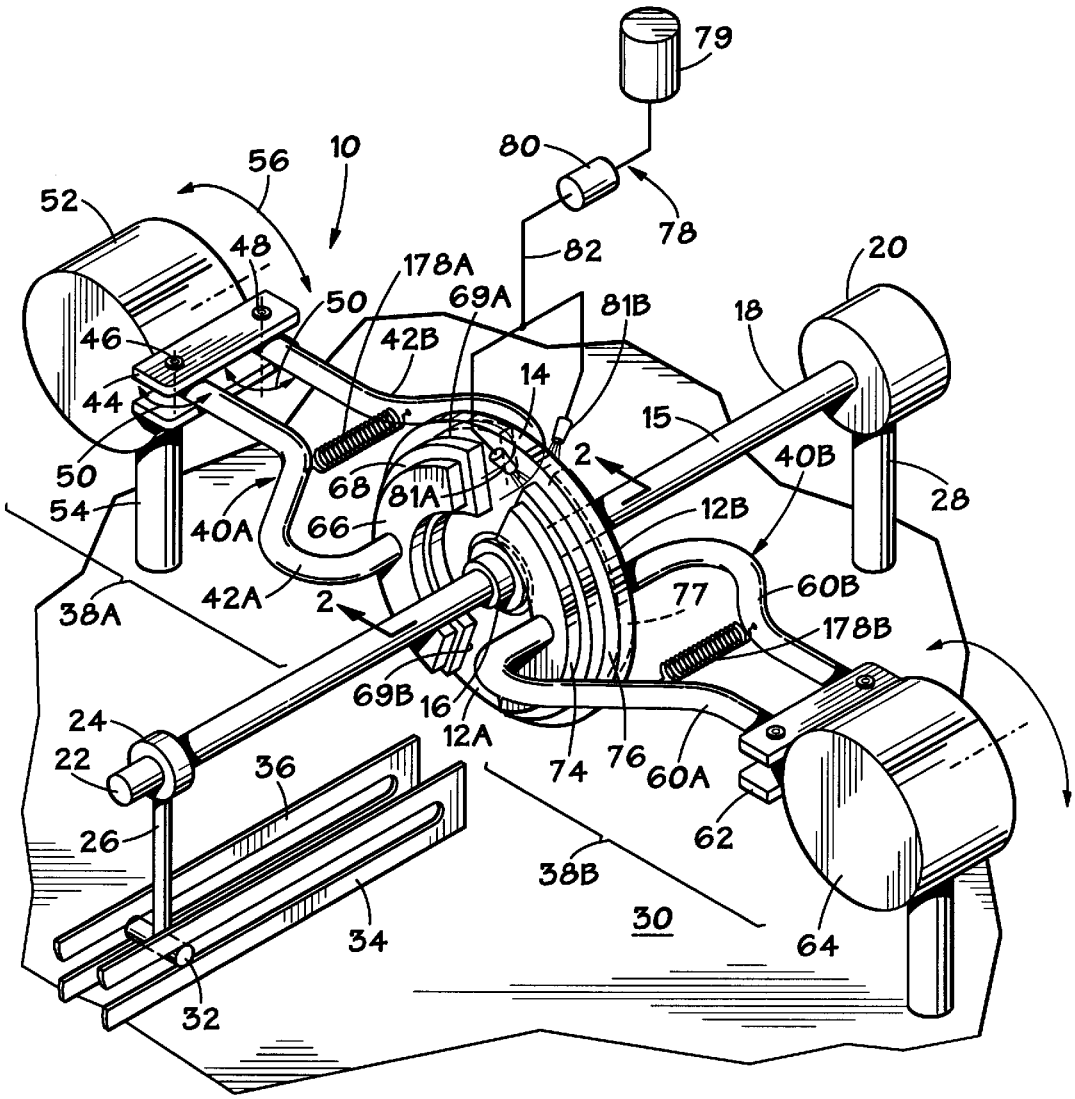
FIG. 1 is a pictorial view of an exemplary embodiment of an apparatus for polishing a wafer in accordance with the present invention.

In the drawings described below, reference numerals are generally repeated where identical elements appear in more than one figure. Turning now to the drawings, and in particular to FIG. 1, there is shown an exemplary embodiment of an apparatus 10 for polishing the first and second sides 12A and 12B of a semiconductor wafer 14 in accordance with the present invention. The wafer 14 may be silicon, silicon-on-insulator, or other suitable semiconductor wafer materials. The polishing is advantageously performed with the aid of a polishing mixture that is dispensed on the sides 12A and 12B.

The wafer 14 is secured to a mandrel 15 by a coupling 16. One end 18 of the mandrel 15 is coupled to a motor 20. The other end 22 of the mandrel 15 is rotatably secured to a bearing 24. The coupling of the end 18 to the motor 20 is depicted schematically as a direct coupling. However, the skilled artisan will appreciate that torque may be transmitted to the mandrel 15 through a step-up or reduction gearing assembly, via a belt and pulley arrangement, or other drive linkages. The mandrel 15 is designed to spin the wafer 14 at rates of up to 10,000 rpm or greater, and is advantageously composed of a material of sufficient stiffness to produce very little deflection throughout the anticipated speed range, and that is resistant to chemical attack by the various polishing fluids dispensed on the wafer 14. Corrosion resistance is desirable to avoid contaminating the wafer 14 with corrosion particulates that might fling off of the exterior of the mandrel 15 during high speed rotation. Exemplary materials include stainless steel, Inconel, MP35N alloy, or like materials.

The motor 20 is designed to selectively rotate the mandrel 15 through a range of speeds suitable for polishing the wafer 14. The speed range may extend to rates of up to 10,000 rpm or greater. The motor 20 may be powered by AC or DC current, or fluid turbine, and as described more below, should be configured to generate enough torque to quickly overcome friction forces applied to the wafer 14. If the motor 20 is not otherwise isolated from the polishing mixture dispensed on the wafer 14, the enclosure of the motor 20 should be designed to isolate the internal structure of the motor 20 from those ambient materials.

The motor 20 and the bearing 24 are respectively supported by structure depicted schematically as the support pegs 26 and 28 projecting upward from a common base 30. The peg 26 is mounted on a roller 32 disposed in slotted rails 34 and 36 so that the bearing 24 may be moved longitudinally with respect to the wafer 14. It is necessary to move the bearing 24 off of the mandrel 15 so that the wafer 14 can be slipped over the mandrel 15 and secured by the coupling 16. The bearing 24 may then be slipped back over the mandrel 15 and moved longitudinally proximate the wafer 14. The pegs 26 and 28, as well as the base 30 are intended to be illustrative only as the apparatus 10 will generally be surrounded by an enclosure to reduce the possibility of contamination as well as splattering of the polishing mixture. The configuration of the enclosure is largely a matter of design discretion.

Referring now also to FIG. 2, which is a cross-sectional view of FIG. 1 taken at section 2—2, the apparatus 10 is provided a with polisher assembly 38A and may be provided with a polisher assembly 38B. The polisher assemblies 38A and 38B include respective caliper assemblies 40A and 40B. The caliper assembly 40A is provided with opposable caliper fingers 42A and 42B that are respectively pivotally coupled to a member 44 by pivot pins 46 and 48. The pivotable character of the fingers 42A and 42B is indicated by the arrows 50. The member 44 is coupled to a rotatable joint 52 that is supported by a peg 54 coupled to the base 30 and is rotatable as indicated by the arrow 56. As with the pegs 28 and 26, the peg 54 is intended to be a schematic representation of a support for the rotatable joint 52. The caliper assembly 38B is provided with an identical set of caliper fingers 60A and 60B pivotably coupled to a member 62 via pivot pins 63A and 63B. The member 62 is coupled to a rotatable joint 64. The fingers 60A and 60B, the member 62 and the rotatable joint 64 may be substantially identical to the fingers 42A and 42B, the member 44, and the joint 52. The members 44 and 64 may be welded or otherwise coupled to the joints 52 and 64. The joints 52 and 64 may be may be powered by electric stepping motors, servos, fluid drives, or like mechanisms.

A polish plate 66 is coupled to the caliper finger 42A. A polish pad 68 is, in turn, coupled to the plate 66. The plate 66 may be coupled to the caliper finger 46 by welding, threaded connection, or other suitable fastening methods. The polish pad 68 is advantageously coupled to the plate 66 by a suitable adhesive, such as an epoxy or other fastening techniques. Alternatively, where the polish pad 68 is composed of a moldable material, such as latex, the polish pad 68 may be integrally molded to the plate 66. The polish pad 68 is advantageously configured in a generally arcuate shape with an outer edge 69A and an inner edge 69B. An arcuate configuration aids in ensuring that portions of the side 12A near the outer and inner edges 69A and 69B are polished to the same extent as the portion of the side 12A that is positioned between the edges 69A and 69B. An other than arcuate shape may be used where the area to be polished is separated from the edges or where polish uniformity at the inner and outer radii of the wafer 14 is not important. The plate 66 not only serves as an interface between the caliper finger 42A and the polish pad 68, but also serves to distribute the force applied to the polish pad 68 from the finger 42A more evenly to yield a more uniform polish of the wafer 14. In this regard, the plate 66 should have a surface area that is close to if not larger than the surface area of the pad 68.

The finger 44B is provided with a substantially identical polish plate 70 and polish pad 72 combination. Similarly, the finger 60A is provided with a substantially identical plate 74 and pad 76 combination, as is the finger 60B. The plate for the finger 60B is not shown and the pad 77 is shown in phantom.

The fingers 42A and 44B are biased toward each other, and thus, the pad 62 and the corresponding pad 72 for the finger 44B are maintained in physical contact with the respective sides 12A and 12B of the wafer 14 by a biasing member 78A that is coupled to the fingers 46 and 48. Another biasing member 78B is coupled to the fingers 60A and 60B. In the embodiment illustrated in FIG. 1, the biasing members are coil springs composed of a suitable material and suitably sized to maintain the pads 68, 72, 76 and 77 in physical contact with the respective sides 12A and 12B with a preselected force. The requisite force will depend upon a variety of parameters, such as the surface area of the pad 62, the flexibility of the fingers 42A, 42B, 60A and 60B, the type of polishing mixture, among others. The force applied by two opposing pads, such as the pads 68 and 72, will be advantageously balanced by the caliper assembly 40A. In this way, the potential for dishing is reduced.

Prior to installation of the wafer 14 on the mandrel 15, the polisher assemblies 38A and 38B are rotated vertically until the caliper assemblies 40A and 40B are rotated up and out of the way. The wafer 14 is then slipped over the mandrel 15 and secured into position by the coupling 16. The polisher assemblies 38A and 38B are then rotated downward and the fingers 42A, 42B, 60A and 60B are spread apart manually and slipped down on either side of the wafer 14. When properly positioned, the fingers 42A, 42B, 60A and 60B are released, enabling the biasing members 78A and 78B to bias the pads 68 and 72 and 76 and 77 into contact with the respective sides 12A and 12B.

The pads 68, 72, 76 and 77 may be composed of a variety of materials. For example, the pads 68, 72, 76 and 77 may be composed of compliant materials, such as latex, natural rubber, or like materials. Alternatively, the pads 68, 72, 76 and 77 may be composed of a ceramic material, such as aluminum oxide, tungsten carbide or like materials. It anticipated that a ceramic material will yield a much longer pad life and better planarity.

A polishing mixture supply system 78 is provided to dispense a polishing mixture on the sides 12A and 12B. The system 78 includes a main reservoir 79 that is provided with a supply of polishing mixture. The main reservoir 79 is connected to a supply pump 80 that draws polishing mixture from the reservoir 79 and delivers it to respective supply nozzles 81A and 81B disposed proximate the respective sides 12A and 12B. The nozzles 81A and 81B are connected to the pump 72 by a supply line 82 and are designed to spray the mixture on the sides 12A and 12B. Alternatively, the pump may be disabled, and the polishing mixture allowed to gravity drip onto the sides 12A and 12B.

The polishing mixture may be composed of a variety of suitable CMP mixtures or more predominantly mechanical polishing mixtures. For example, the polishing mixture may be composed of two phase slurries consisting of particulates of a high hardness abrasive dispersed in a liquid matrix that functions both as a coolant and a carrier for polish cuttings. Examples of such mixtures includes diamond or silicon carbide slurried with oil, or like slurries. Alternatively, where a ceramic material is used to fabricate the pads 68, 72, 76 and 77, the polishing mixture may consist of liquid alone. In this circumstance, the pads 68, 72, 76 and 77 supply the polishing abrasive, and the liquid serves as a coolant and medium to convey cuttings away from the surfaces 12A and 12B. Exemplary liquids include water, oil, or other suitable polishing liquids. Additives to enhance chemical reaction may be added. For example, iron particles may be added where tungsten is polished so that the more easily abraded tungsten trioxide is formed during the polish.

The detailed structure of the connection between the coupling 16, the wafer 14, and the mandrel 15 may be understood by referring now to FIGS. 1, 2 and to FIG. 3, which is an end view of the side 12B of the wafer 14. The wafer 14 is depicted as a circlet wafer that has an inner ring 83 provided with a central opening 84 through which the mandrel 15 is journalled. The inner ring 83 is designed to permit the wafer 14 to be handled during transport and other processing without risk of damaging the otherwise delicate first and second sides 12A and 12B thereof. Accordingly, the ring 83 is advantageously composed of a hard chemically inert material, such as a ceramic, diamond, silicon carbide, or like materials.

The coupling 16 is composed of two mating halves 85A and 85B which share a common bore 86 through which the mandrel 15 is journalled. The halves 85A and 85B are threadedly engaged at 87. The half 85A is advantageously secured to the mandrel 15 so that it will rotate along with the mandrel 15. This may be accomplished by providing an interference fit between the half 85B and the mandrel 15, by welding, or by other suitable fastening techniques. The half 85A is provided with a relatively loose fit about the mandrel 15 so that the wafer 14 may be loaded onto the mandrel 15 by sliding the half 85A off of the mandrel, sliding the wafer 14 onto the mandrel and abutting it against the half 85B and again sliding the half 85A onto the mandrel and screwing it into the half 85B. The halves 85A and 85B are advantageously composed of the same materials used to fabricate the mandrel 15.

The halves 85A and 85B are provided with respective elastomeric members 88 and 90. The elastomeric members 88 and 90 provide a relatively soft and compliant interface between the halves 85A and 85B and the inner ring 83. A soft and compliant cushion between the halves 85A and 85B and the inner ring 83 is desirable from both alignment and surface protection standpoints. Variations in the thickness of the inner ring 83 that might otherwise cause the wafer to be misaligned vertically when engaged by the coupling 16 will be compensated by the elastomeric character of the elastomeric members 88 and 90. Similarly, the surfaces of the inner ring 83, and particularly the wafer 14 are protected from scratching or other damage by the halves 85A and 85B. This protection is important where the ring 83 is fabricated with an irregular diameter so that the halves 85A and 85B actually come into contact with the surfaces 12A and 12B of the wafer 14. The elastomeric members 88 and 90 are advantageously composed of a suitable elastomeric material that is resistant to chemical attacked by the semiconductor processing fluids anticipated. Exemplary materials include natural rubber, nitrile rubber, polyurethane, or like materials.

The engagement of the halves 85A and 85B clamps the wafer 14 into position so that rotation of the mandrel 15 will readily rotate the wafer 14. The physical engagement between the wafer 14 and the mandrel is further enhanced by the inherent tackiness of the elastomeric members 88 and 90. However, an additional physical mechanism may be incorporated to transmit torque from the mandrel 15 to the wafer 14. In this regard, as shown in FIG. 3, the inner ring 83 may be provided with a longitudinal slot 92 and the half 85B may be provided with a longitudinally projecting key 94 that slides into the slot 92. In this way, torque applied to the mandrel 15 is transmitted directly to the inner ring 83 by the key 94.

Figure 4:
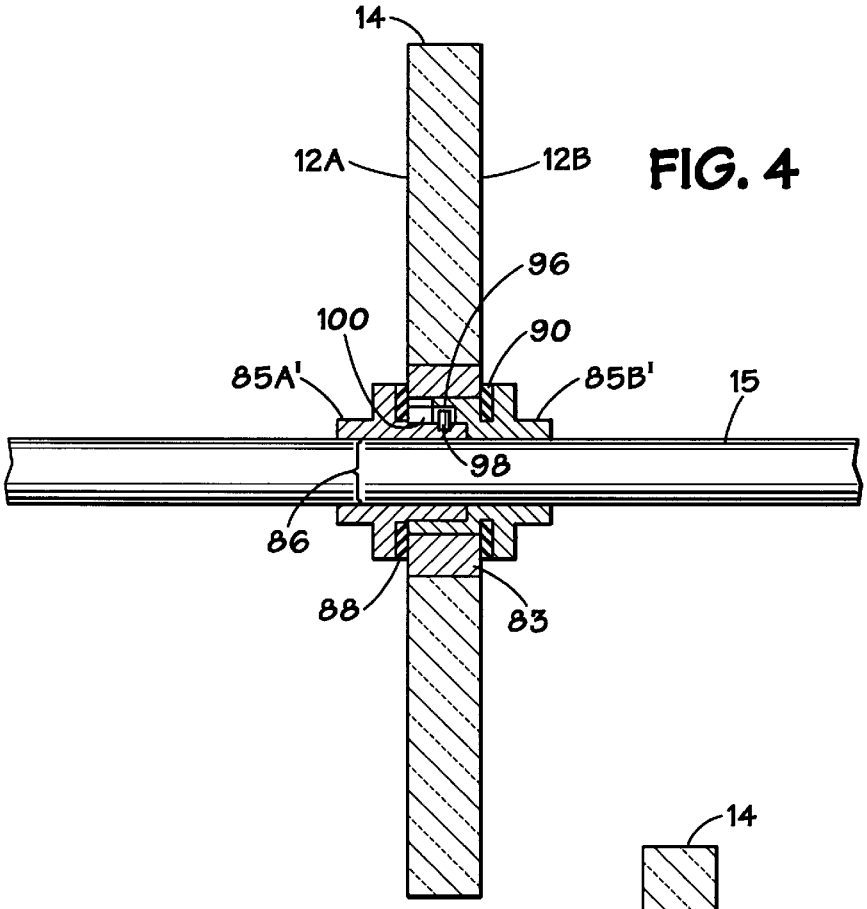
FIG. 4 is a cross-sectional view like FIG. 2 of an alternate mandrel coupling in accordance with the present invention.

In an alternate embodiment depicted in FIG. 4, the halves, now designated 85A' and 85B' are secured together by a quick disconnect mechanism consisting of an internal groove 96 in the half 85B' and a mating pin 98 projecting radially outwardly from the half 85A'. For simplicity of illustration, the rotatable coupling 56, the pads 68 and 72, and the plates 66 and 70 are not shown. The structure is similar to a quick coupling commonly used on large outdoor sprinkler systems. The half 85A' is inserted into the half 85B' so that the pin 98 passes longitudinally through a longitudinal slot 100 in the half 85B' until the pin 98 reaches the internal groove 96. At this point, the half 85A' is rotated to engage the pin 98 within the groove 96 to firmly secure the half 85A' to the half 85B'.

Figure 5:
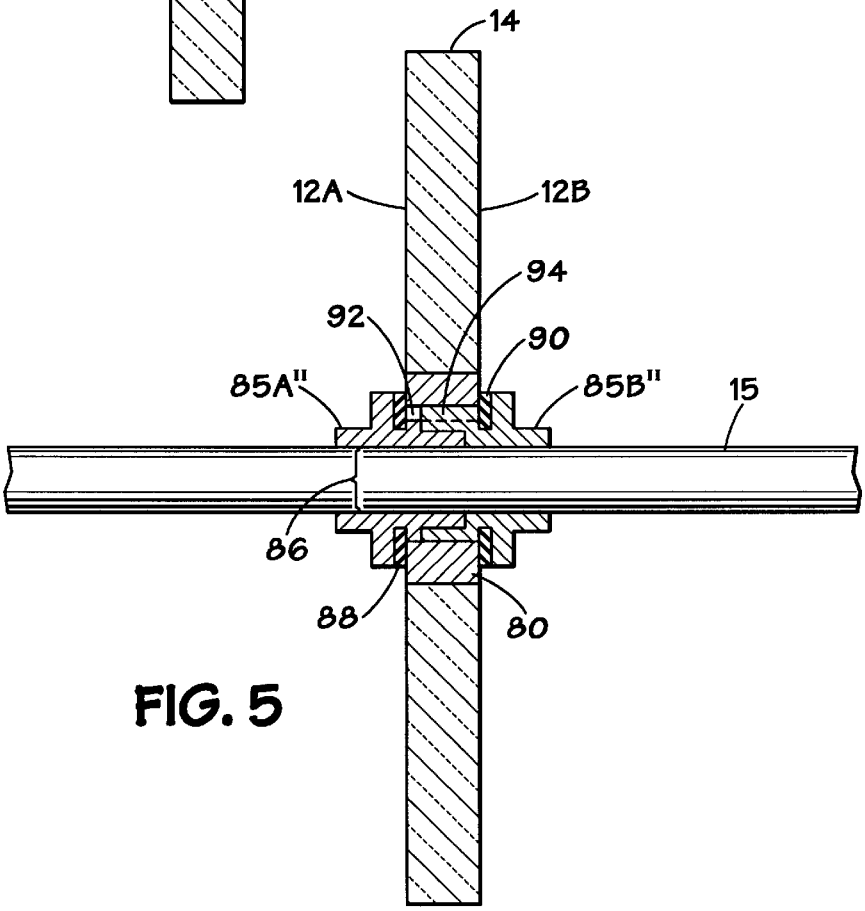
FIG. 5 is a cross-sectional view like FIG. 2 of another alternate mandrel coupling in accordance with the present invention.

In another alternate embodiment depicted in FIG. 5, the halves, now designated 85A" and 85B", are secured to each other by magnetism. The magnetic attraction between the halves 85A" and 85B" may be accomplished by fabricating both the halves 85A" and 85B" as permanent magnets and orienting them with their opposite poles in close proximity to provide a secure magnetic attraction there between. Alternatively, one of the halves 85A" or 85B" may be fabricated as a permanent magnet and the other half, 85A" or 85B" as the case may be, may be fabricated from a ferromagnetic material that will be strongly attracted to the permanent magnet.

Figure 6:
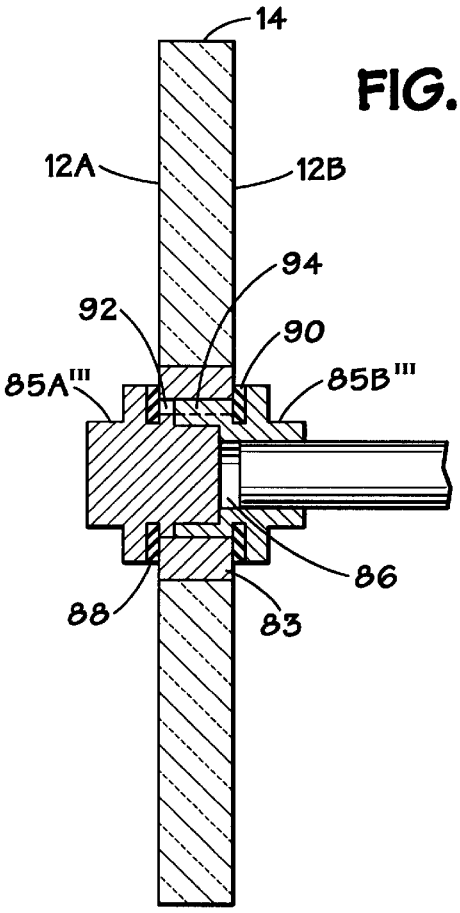
FIG. 6 is a cross-sectional view like FIG. 2 of another alternate mandrel coupling in accordance with the present invention.

FIG. 6 depicts another alternate embodiment wherein the mandrel, now designated 15' terminates in the half, now designated 85B". The other half 85A" may be secured to the half 85B" by magnetism as shown in FIG. 6 or by any of the other aforementioned fastening techniques shown in FIGS. 3 and 4, or other suitable fastening techniques. This embodiment eliminates the requirement for journalling the mandrel 15' through the bearing 24. Where the total length of the mandrel 15' is short enough in view of the anticipated revolutions/minute and the condition and configuration of the bearings in the motor 20, no further external bearings to support the mandrel 15' may be necessary.

In all of the aforementioned embodiments, the wafer 14 is secured to the mandrel 15 in an upright or substantially vertical orientation. This orientation provides for quick dispersal of polishing mixture and simplifies vertical alignment of various components, such as the motor 20, the bearing 24, if present, and the polisher assemblies 38A and 38B. However, precise vertical orientation is not necessary.

The operation of the apparatus 10 may be understood by referring now to FIG. 1. The bearing 24 is moved longitudinally off of the mandrel 15 and the polisher assemblies 38A and 38B are rotated vertically so that the caliper assemblies 40A and 40B are moved away from the mandrel 15. The wafer 14 is then slipped over and secured to the mandrel 15 by the coupling 16. The manner in which the coupling 16 secures the wafer 14 to the mandrel 15 will depend upon the precise configuration of the coupling. Note that a number of different variations for the coupling 16 have been described herein. After the wafer 14 is secured to the mandrel 15, the bearing 24 is moved longitudinally so that the mandrel 15 again journals through the bearing 24 and the polisher assemblies 38A and 38B are rotated downward until the pads 68, 72, 76 and 77 are pressed against the sides 12A and 12B. As noted above, the pairs of caliper fingers 42A and 42B and 60A and 60B may be spread slightly to enable the pads 68, 72, 76 and 77 to slide past the edge of the wafer 14 and moved down into position.

An initial volume of the polishing mixture is dispensed on the sides 12A and 12B from the nozzles 74 and 76. This may be accomplished while the motor 20 is running and wafer 14 is being rotated slowly, e.g., approximately 100 RPM or less or while the wafer 14 is held stationary and then subsequently rotated at the same slow RPM. In either case the result is a coating on the portions of the sides 12A and 12B contacted by the polish pads 68, 72, 76 and 77. The motor 20 may then be activated to spin the wafer 14 at a preselected speed until a desired amount of material is removed from the sides 12A and 12B. Additional mixture may be dispensed as necessary during the polish cycle.

The friction forces between the pads 68, 72, 76 and 77 and the sides 12A and 12B may be significant, particularly at start up. Accordingly, the motor 20 should have a high enough torque output to readily overcome the friction forces and spin the wafer 14. The desired speed will depend upon a number of parameters, such as the hardness of the material on the sides 12A and 12B that is being planarized, the abrasive qualities of the polishing mixture, the amount of material to be removed, and the desired material removal rate. For example, a tetra-ethyl-ortho-silicate ("TEOS") layer may be polished with aluminum oxide pads and a diamond-oil slurry mixture at a rotational speed of 100 to 3000 RPM.

The end point of the main polish cycle may be detected by lithometry, elipsometry, or other suitable techniques. If post-main cycle inspection reveals surface defects or excessive layer thickness, a touch up cycle may be run following the main polishing cycle. The speed range for the touch up cycle may be, for example, about 100 to 1500 RPM.

The apparatus and method of the present invention provide for simultaneous polishing of both sides 12A and 12B of the two sided wafer 14, in situ and without removal or other spatial manipulation of the wafer 14. As material is removed from the sides 12A and 12B during polishing, the pads 68, 72, 76 and 77 are automatically forced against the sides 12A and 12B by the pincer action of the caliper fingers 42A, 42B, 60A and 60B and the biasing members 78A and 78B. Highly uniform planarization may be established simultaneously on both sides of a given wafer, resulting in better yields and much higher manufacturing efficiency. Note that if polishing on a single side of the wafer 14, such as the side 12A, is desired, polishing mixture may be applied to only the side 12A. In this case, the opposing polish pads 76 and 77 function primarily to balance the wafer 14 to prevent warping during polishing of the side 12A.

Figure 7:
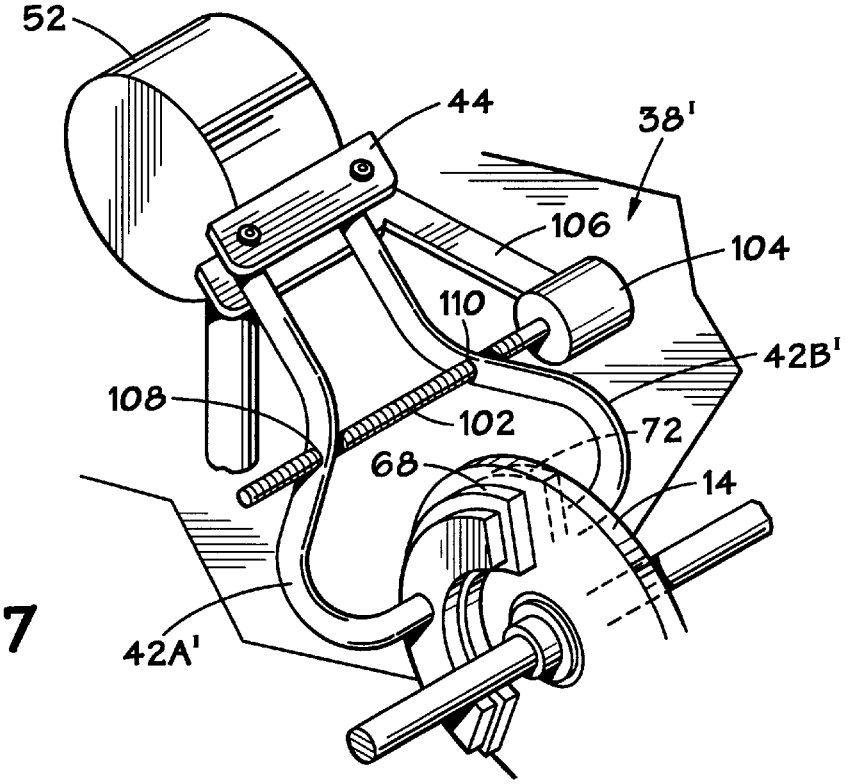
FIG. 7 is a pictorial view of an alternative polisher assembly in accordance with the present invention.

An alternate embodiment of the polisher assemblies 38A and 38B, now designated 38', is depicted in FIG. 7, which is a pictorial view of the polisher assembly 38' and just a portion of the wafer 14. In this embodiment, the fingers, now designated 42A' and 42B', are pivoted by a power screw 102 coupled to a motor 104. The motor 104 is connected to the member 44 or the rotatable joint 52 by a member 106. The power screw 102 passes through internally threaded bores 108 and 110 in respective fingers 42A' and 42B'. Activation of the motor 104 rotates the power screw 102 to bring the pads 68 and 72 into engagement with the wafer 14 or move the pads 68 and 72 away from the wafer 14, depending on the direction of rotation of the motor 104. Like the mandrel 15, the power screw 102 and the housing of the motor 104 should be fabricated from corrosion resistant materials.

In operation, the polish assembly 38' is pivoted out of the way to permit installation of the wafer 14. The assembly 38' is then pivoted downward until the pads 68 and 72 are proximate the desired locations on the sides 12A and 12B and the motor 104 is activated to bring the pads into engagement with the wafer 14. The wafer 14 may then be polished as described above. The process may be reversed to remove the wafer 14.

Figure 8:
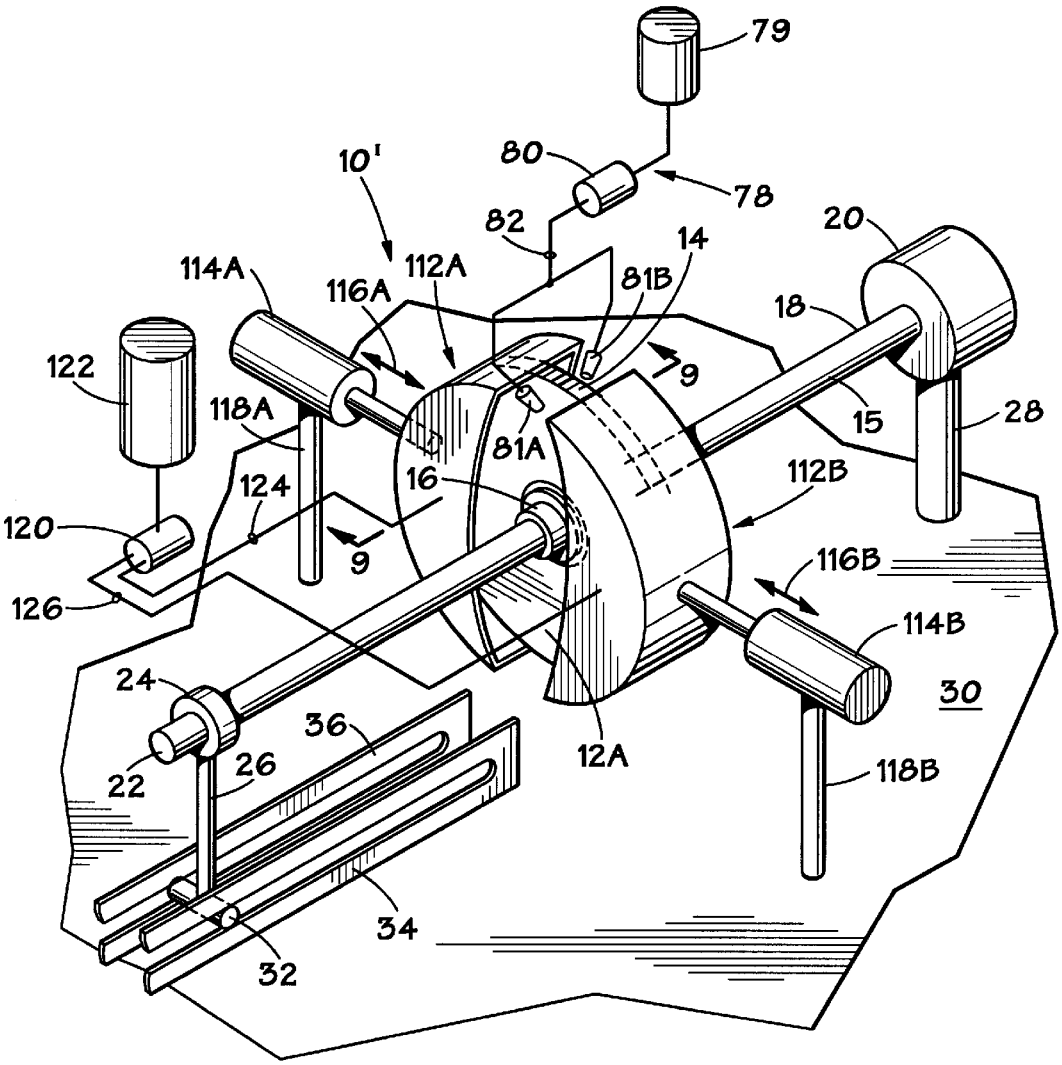
FIG. 8 is a pictorial view of another alternate exemplary embodiment of a polishing apparatus in accordance with the present invention.

FIG. 8 is a pictorial view of another alternate embodiment of the apparatus, now designated 10'. In this embodiment, the apparatus 10' is provided with a polisher assembly 112A, and may be provided with a polisher assembly 112B, that are respectively coupled to axially movable fluid driven cylinders 114A and 114B that are operable to selectively move the polisher assemblies 112A and 112B axially as indicated by the arrows 116A and 116B. The fluid driven cylinders 114A and 114B are respectively supported on the base 30 by support pegs 118A and 118*b*, which, like the other support pegs referenced above are intended to be schematic illustrations of a support structure. The fluid driven cylinders 114A and 114B may be pneumatic or hydraulic. Alternatively, the fluid driven cylinders 114A and 114B may be linear electric motors that provide for axial movement.

The polisher assembly 112A is supplied with hydraulic or pneudraulic fluid by a pump 120 that draws fluid from a main reservoir 122 and delivers that fluid via a supply line 124. A corresponding supply line 126 is coupled between the pump 120 and the polisher assembly 112B. The pump 120 is designed to manipulate the pressure of the fluid in the polisher assemblies 112A and 112B. Accordingly, the pump 120 may be an ordinary fluid pump, such as an impeller driven pump. Alternatively, the pump 120 may be a linear motor driven master fluid cylinder that is similar in arrangement to the brake system master cylinder in various high performance wheel brake systems.

Figure 9:
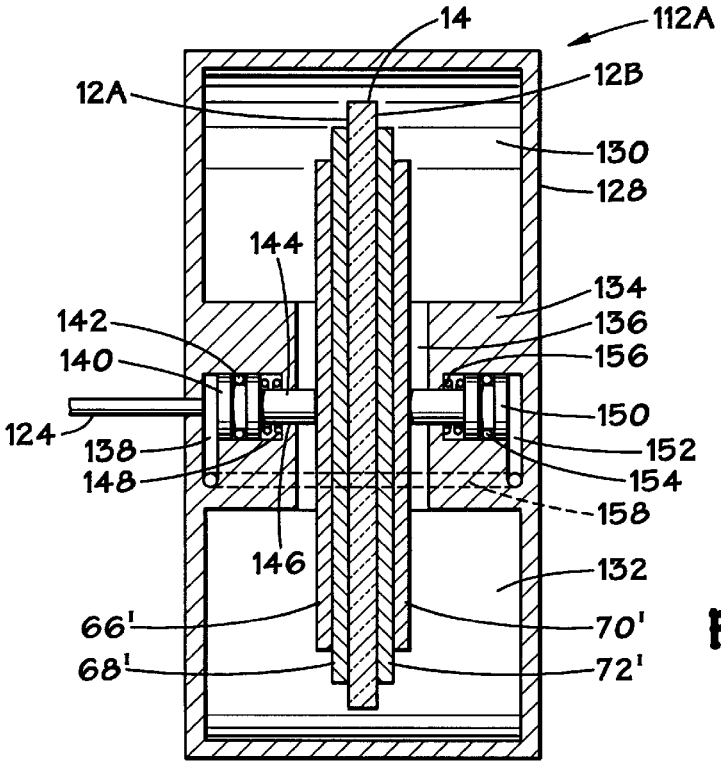
FIG. 9 is a cross-sectional view of FIG. 8 taken at section 9—9.

The detailed structure of the polisher assembly 112A is exemplary of the polisher o assembly 112B and may be understood by referring now also to FIG. 9, which is a cross sectional view of FIG. 8 taken at section 9—9. The polisher assembly 112A includes a generally C-shaped shell 128 that includes generally hollow spaces 130 and 132 at its upper and lower ends that are separated by a centrally disposed bulkhead 134. The bulkhead 134 is provided with an arcuate slot 136 that appears to be rectangular when viewed from FIG. 9 but will appear to be arcuate when viewed from the side. The slot 136, as well as the open spaces 130 and 132 are designed to accommodate a substantial portion of the wafer 14 when the polisher assembly 112A is brought into the position shown in FIG. 8. The left side of the bulkhead 134 is provided with a fluid chamber 138 that is in fluid communication with the fluid supply line 124. A piston 140 is disposed in the chamber 138. One end of the piston 140 is provided with an O-ring seal 142 to prevent high pressure fluid from entering the chamber 138 and passing along the outer surfaces of the piston 140. The other end of the piston 140 transitions into a reduced diameter portion 144 that projects through a bore 146 in the bulkhead 136 and is coupled to a polish plate, of the type described above, but now designated 66'. The polish plate 66' is coupled to a polish pad of the type described above, but now designated 68'. The piston 140 is movable from a position in which the polish pad 68' is not in physical engagement with the wafer 14 to the position shown in FIG. 9, where the polish pad 68' is in physical engagement with the side 12A of the wafer 14. The piston 140 is biased to the aforementioned first position by a spring 148.

The right hand side of the bulkhead 134 is provided with a substantially identical piston 150 that is disposed in a fluid chamber 152 and is provided with an O-ring 154 and a spring 156 that are substantially identical to the O-ring 142 and the spring 148. The chamber 152 is in fluid communication with the chamber 138 via a cross-over conduit 158 shown in phantom. The reduced diameter portion 160 of the piston 150 is coupled to a polish plate 70' that is substantially identical to the plate 66'. Similarly, a polish pad 72' is coupled to the polish plate 70' and is substantially identical to the pad 68'. Like the piston 140, the piston 150 is normally biased away from the wafer 14 by the spring 156.

In operation, the fluid driven cylinders 114A and 114B are actuated to move the polisher assemblies 112A and 112B axially away from the mandrel 15 so that the wafer 14 may be slipped over the mandrel 15 and secured thereto by the coupling 16. The fluid driven cylinders 114A and 114B may then be actuated to move the polisher assemblies 112A and 112B into position straddling the wafer 14. At this point, the fluid pressure in the chambers 138 and 152 is such that the springs 148 and 156 bias the pistons 140 and 150 away from one another so that a sufficient gap will exist between the pads 68' and 72' to accommodate the straddling of the wafer 14. After the polisher assembly 112A has been moved axially so that the pads 68' and 72' straddle the wafer 14, the pressure of the fluid in the chambers 138 and 152 may be raised to urge the pistons 140 and 150 to move axially, bringing the pads 68' and 72' into physical engagement with the respective sides 12A and 12B of the wafer 14. The polisher assembly 112B may be similarly manipulated. The wafer 14 may then be polished as described generally above. To remove the wafer 14, pressure in the chambers 138 and 152 is relieved, enabling the springs 148 and 156 to bias the pistons 140 and 150 and thus the pads 68' and 72' away from the wafer 14. The assemblies 112A and 112B may then be moved axially and the wafer 14 removed.

Figure 10:
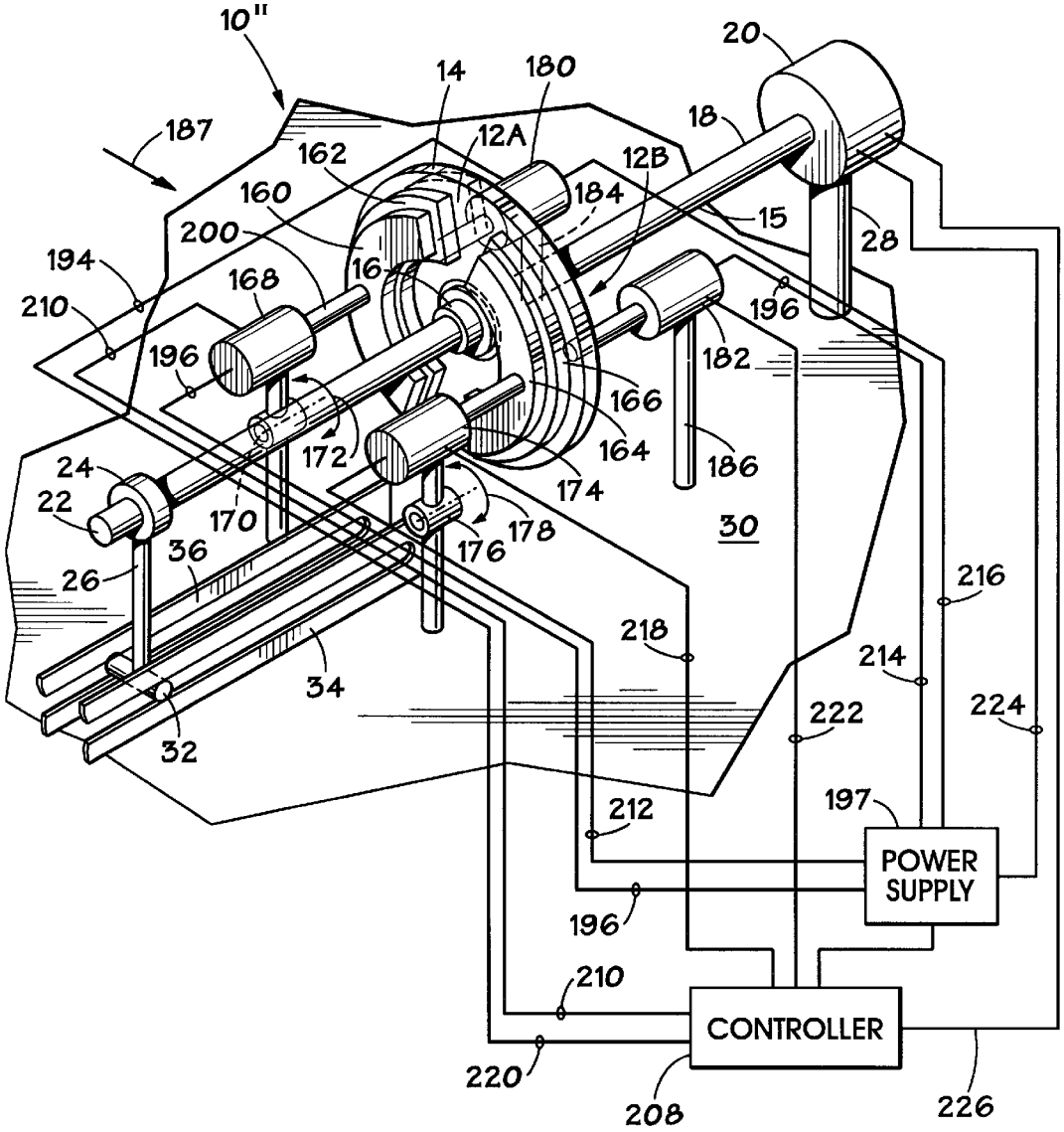
FIG. 10 is a pictorial view of another alternate exemplary embodiment of a polishing apparatus in accordance with the present invention.

Another alternate embodiment of the apparatus, now designated 10", may be understood by referring to the pictorial view in FIG. 10. In this embodiment, the side 12A of the wafer 14 is polished by a combination of a polish plate 160 and polish pad 162 and a corresponding polish plate 164 and polish pad 166. The plates 160 and 164 and the pads 162 and 166 may be of the type generally described above. The plate 160 is coupled to a fluid driven cylinder 168 that is supported on a pivoting joint 170 that is pivotable as indicated by the arrow 172 so that the fluid driven cylinder 168 and the combination of the plate 160 and the pad 162 may be pivoted away from the mandrel 15 to enable the wafer 14 to be slipped over the mandrel 15. A substantially identical fluid driven cylinder 174 is coupled to the plate 164 and pivotally attached to a pivoting joint 176 that is pivotable as shown by the arrow 178 and provides the same function as the pivoting joint 172. The joints 170 and 176 may be powered by electric stepping motors, servos, fluid drives, or like mechanisms.

The backside 12B of the wafer 14 is polished by sets of plates and pads that are substantially identical to the plate 160 and pad 162 combination and/or the plate 164 and pad 166 combination. The plates/pads for polishing the backside 12B are respectively coupled to fluid driven cylinders 180 and 182 that may be fixedly attached to the base 30 by support pegs 184 and 186. The polish may be carried out with a single pair of opposed pads and cylinders.

Figure 11:
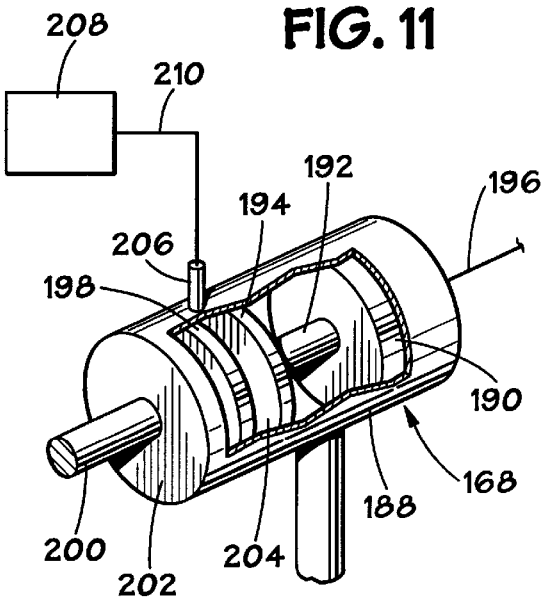
FIG. 11 is a close-up pictorial view of an exemplary fluid driven cylinder depicted in FIG. 10.

The detailed structure of the fluid driven cylinders 168, 174, 180 182 may be understood by referring now also to FIG. 11, which is a close-up pictorial of the fluid driven cylinder 168 viewed from the line of sight indicated by the arrow 187 in FIG. 10. The structure and function of the fluid driven cylinder 182 is exemplary of the other fluid driven cylinders 168, 174 and 180. The fluid driven cylinder 182 includes a housing 188 that is shown partially cut away to reveal the interior thereof. A linear stepping motor 190 is positioned inside the housing and includes an axially projecting shaft 192 coupled to a piston 194. Electrical power is supplied to the motor 190 via a conductor 196 coupled to a power supply 197. A second piston 198 is positioned in the housing 188 and is coupled to a shaft 200 that projects axially out of the end 200 of the housing 188. The shaft 200 is coupled to plate 160. The space between the pistons 194 and 198 defines a fluid chamber 204 which is filled with a charge of working fluid, such as hydraulic fluid or a gas. The pressure of the fluid in the chamber 204 is sensed by a pressure sensor 206 that is connected to the housing 188 and is in fluid communication with the chamber 204. The pressure sensor 206 may be a transducer or like pressure sensor. Signals from the pressure sensor 206 are conveyed to an electronic controller 208 by a conductor 210.

Forward actuation of the motor 190 moves the shaft 192 and piston 194 axially toward the piston 198, compressing the fluid in the chamber 204. In response, the piston 198 is moved axially toward the end 202 and the pad 162 is moved into contact with the side 12A of the wafer 14. The amount of force applied on the side 12A by the pad 162 is sensed indirectly by the pressure sensor 206 and interpreted as a force quantity by the controller 208. Reverse actuation of the motor 190 reduces the pressure on the piston 198 to either reduce the force on the side 12A and/or move the pad 162 out of contact with the side 12A. The axial movements of the motor shaft 192 may be finely tuned so that the force applied by the pad 162 may be tightly controlled. The result is better control over planarization uniformity. Note that the motor 190 may be remote from the housing 188 so long as fluid communication is maintained between the piston 194 and piston 198.

The fluid driven cylinders 174, 180 and 182 are connected to the power supply 197 and the controller 208 via respective power conductors 212, 214, and 216, and signal conductors 218, 220 and 222. The mandrel motor 20 may be connected to the power supply 197 and the controller 208 via conductors 224 and 226 so that the RPM of the motor 20 may be controlled electronically.

The power supply 197 may be AC or DC or capable of supplying both. The controller 208 may be a computer, a programmable controller or other type computing device. The controller is operable to interpret data supplied by the pressure sensor 206 and the corresponding sensors on the other fluid driven cylinders 174, 180 and 182, and to control the operation of the fluid driven cylinders 168, 174, 180 and 182, and the motor 20, and if desired, the rotatable joints 170 and 176. The signals produced by the sensor 206 and the corresponding sensors on the other fluid driven cylinders 174, 180 and 182 are typically analog. Accordingly the controller 208 may incorporate analog-to-digital and digital to analog converters to process those signals and any other analog signals.

In operation, the fluid driven cylinders 168 and 174 and the corresponding sets of plates and pads 160 and 162 and 164 and 166 are pivoted away from the mandrel 15 to make room for the wafer 14. The wafer 14 is then slipped over the mandrel 15 and secured thereto by the coupling 16. The fluid driven cylinders 168 and 174 are then pivoted back towards the mandrel 15 and actuated to move the plate 160 pad 162 and the plate 164 and pad 166 axially until the pads 162 and 166 engage the side 12A of the wafer 14. At the same time, the corresponding combinations of plates and pads coupled to the fluid driven cylinders 180 and 182 are moved axially into physical engagement with the side 12B by actuating the fluid driven cylinders 186 and 188. A polishing mixture maybe applied to the sides 12A and 12B using a dispensing system not shown in FIG. 10 but of the type depicted in FIG. 1 and designated generally at 78.

The wafer 14 may then be polished as generally described above. The conditions of the polish are monitored by the controller 208. The controller 208 may be programmed to keep the force applied to the sides 12A and 12B constant or variable through a preselected regimen. During the polish cycle, the controller 208 interprets pressure signals from the pressure sensors for the cylinders 168, 174, 180 and 182 and compares those signals to a value or values representing the preselected desired pressure. If the controller 208 detects undesirable variations in force or RPM, it will transmit control signals to the fluid driven cylinders 168, 174, 180 and 182 and/or the motor 20 to make appropriate adjustments. To remove the wafer 14, the aforementioned process is reversed, that is, the fluid driven cylinders 168, 174, 180, and 182 are reversed and the fluid driven cylinders 168 and 174 are pivoted away from the mandrel 15 so that the wafer 14 may be removed.

The automation of the embodiment depicted in FIGS. 10 and 11 may be applied to the embodiments depicted in FIGS. 1, 7 and 8. In this way the various components depicted in relation of those alternate embodiments may be controlled and otherwise manipulated by a controller like the controller 208 depicted in FIG. 10.

Figure 12:
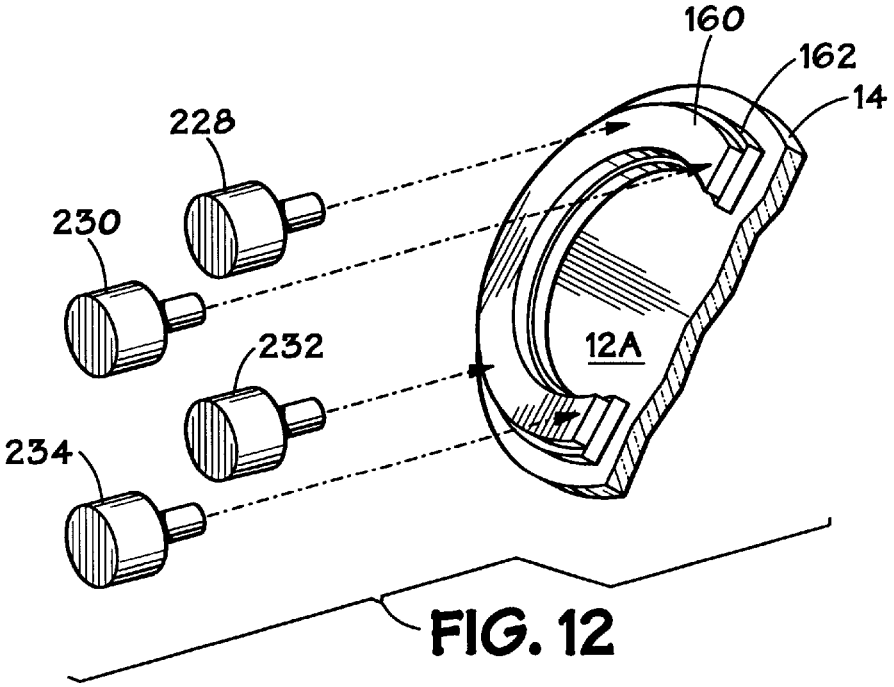
FIG. 12 is an exploded pictorial view of an alternate exemplary embodiment of a polisher assembly in accordance with the present invention.

Force may be applied by a pad, such as the pad 162, to a given side of the wafer 14 with greater sensitivity to the condition of the wafer surface by increasing the number of fluid driven cylinders coupled to the pad 162. A variation of the embodiment depicted in FIGS. 10 and 11 incorporating this concept may be understood by referring now to FIG. 12, which is close-up pictorial view of the plate 160 and pad 162 coupled to four spaced-apart fluid driven cylinders 228, 230, 232 and 234. The fluid driven cylinders 228, 230, 232 and 234 are shown exploded from the plate 160. Each of the fluid driven cylinders 228, 230, 232 and 234 may be substantially identical to the fluid driven cylinders 168, 174, 180 and 182 and connected in like fashion to the power supply 197 and the controller 208 shown in FIG. 10. The incorporation of multiple fluid driven cylinders sub-divides the force applied to the pad 162 into zones. The force delivered in a particular zone may be sensed and controlled by manipulating the particular fluid driven cylinder for the zone. Since the pad 162 is a single member, the sensing and control of an individual fluid driven cylinder will not be completely independent from the actions of the other fluid driven cylinders. However, the force applied to the surface 12B may, nevertheless, be more tightly monitored and controlled. The number and arrangement of the fluid driven cylinders 228, 230, 232 and 234 is largely a matter of design discretion.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents and alternatives falling within the spirit and scope of the invention as defined by the following appended claims. For example, the mandrel described above may spatially manipulated to provide clearance to so that a wafer may be installed thereon.

What is claimed is:

1. An apparatus for polishing a semiconductor wafer having first and second sides and a central opening, comprising:

a mandrel for holding the wafer;

a motor coupled to the mandrel and being operable to rotate the mandrel; and a first polisher assembly having a first polish pad for polishing the first side of the wafer and a second polish pad for polishing the second side of the wafer, and a first caliper assembly having a first finger having a first end coupled to the first polish pad and a second end pivotably coupled to a member, and a second finger opposable to the first finger and having a third end coupled to the second polish pad and a fourth end pivotably coupled to the member, and a power screw threadedly coupled to the first and second fingers and to a motor being operable to rotate the power screw clockwise and counterclockwise to pivot the first and second fingers.

2. The apparatus of claim 1, comprising a second polisher assembly having a third polish pad for polishing the first side of the wafer and a fourth polish pad for polishing the second side of the wafer, and means for moving the third and fourth polish pads into and out of engagement with the first and second sides of the wafer.

3. The apparatus of claim 2, wherein each of the first and second polisher assemblies comprises a pivotable joint to enable the respective polisher assembly to be pivoted away from the mandrel and the wafer to be coupled to the mandrel.

4. The apparatus of claim 3, wherein the means comprises a second caliper assembly having a third finger having a first end coupled to the third polish pad and a second end pivotably coupled to a second member, and a fourth finger opposable to the third finger and having a third end coupled to the fourth polish pad and a fourth end pivotably coupled to the second member, and a biasing member coupled to the third and fourth fingers to bias the third and fourth fingers toward each other.

5. The apparatus of claim 3, wherein the second means comprises a second caliper assembly having a third finger having a first end coupled to the third polish pad and a second end pivotably coupled to a member, and a fourth finger opposable to the third finger and having a third end coupled to the fourth polish pad and a fourth end pivotably coupled to the member, and a second biasing member coupled to the third and fourth fingers to bias the third and fourth fingers toward each other.

6. The apparatus of claim 3, wherein the first, second, third and fourth polish pads are composed of a ceramic material.

7. The apparatus of claim 6, wherein the ceramic material comprises aluminum oxide.

8. The apparatus of claim 1, comprising a polishing mixture dispenser having first and second nozzles for dispensing polishing mixture to the first and second sides of the wafer, and a reservoir for delivering a quantity of polishing mixture to the first and second nozzles.

9. The apparatus of claim 8, comprising a pump coupled to the reservoir and the first and second nozzles for pumping mixture from the reservoir to the nozzles.

10. An apparatus for polishing a semiconductor wafer having first and second sides and a central opening, comprising:

a mandrel for the wafer;

a motor coupled to the mandrel and being operable to rotate the mandrel; and a first polisher assembly having a first polish pad for polishing the first side of the wafer and a first fluid driven cylinder coupled to the first polish pad for moving the first polish pad into and out of engagement with the first side of the wafer, and a second polish pad for polishing the second side of the wafer and a second fluid driven cylinder coupled to the second polish pad for moving the second polish pad into and out of engagement with the second side of the wafer, each of the first and second fluid driven cylinders having a housing, a first piston coupled to one of the polish pads, a second piston, and a linear motor coupled to the second piston, the housing, the first piston and the second piston defining a fluid chamber containing a volume of fluid whereby action of the motor moves the end piston axially to change the pressure in the fluid chamber and moves the first piston.

11. The apparatus of claim 10, comprising an electronic controller connected to the motor and to the first and second linear motors for controlling the operation thereof.

12. The apparatus of claim 10, wherein each of the first and second fluid driven cylinders includes a pressure sensor to sense the pressure in the fluid chamber, the pressure sensor being operable to transmit signals to the electronic controller, the controller being operable to interpret the pressure sensor signals and to maintain preselected pressure in the fluid chambers by comparing the pressure sensor signals to a value representing the preselected pressure and adjusting the operation of the first and/or the second linear motors where the pressure signals indicate a deviation from the preselected pressure.

13. The apparatus of claim 10, comprising a second polisher assembly having a third polish pad for polishing the first side of the wafer and a third fluid driven cylinder coupled to the third polish pad for moving the third polish pad into and out of engagement with the first side of the wafer, and a fourth polish pad for polishing the second side of the wafer and a fourth fluid driven cylinder coupled to the fourth polish pad for moving the fourth polish pad into and out of engagement with the second side of the wafer.

14. The apparatus of claim 13, wherein each of the third and fourth fluid driven cylinders comprises a housing, a first piston coupled to one of the third or fourth polish pads, a second piston, and a linear motor coupled to the second piston, the housing, the first piston and the second piston defining a fluid chamber containing a volume of fluid whereby actuation of the motor moves the second piston axially to change the pressure in the fluid chamber and move the first piston.

15. The apparatus of claim 14, wherein each of the third and fourth fluid driven cylinders includes a pressure sensor to sense the pressure in the fluid chamber.

16. The apparatus of claim 14, comprising an electronic controller connected to the motor and to the third and fourth linear motors for controlling the operation thereof.

17. The apparatus of claim 13, wherein the first, second, third and fourth polish pads are composed of a ceramic material.

18. The apparatus of claim 17, wherein the ceramic material comprises aluminum oxide.

19. The apparatus of claim 10, comprising polishing mixture dispenser having first and second nozzles for dispensing polishing mixture to the first and second sides of the wafer, and a reservoir for delivering a quantity of polishing mixture to the first and second nozzles.

20. The apparatus of claim 19, comprising a pump coupled to the reservoir and the first and second nozzles for pumping mixture from the reservoir to the nozzles.

21. The apparatus of claim 10, wherein one of the first or second fluid driven cylinders is pivotable away from te mandrel to enable the wafer to be positioned on the mandrel.

22. An apparatus for polishing a semiconductor wafer having first and second sides and a central opening, comprising:

a mandrel for holding the wafer;

a motor coupled to the mandrel and being operable to rotate the mandrel; and a first polisher assembly having a housing including a first piston positioned in a first fluid chamber and coupled to a first polish pad for polishing the first side of the wafer and a second piston positioned in a second fluid chamber and coupled to a second polish pad for polishing the second side of the wafer, the first piston being operable to move the first polish pad into and out of engagement with the first side of the wafer and the second piston being operable to move the second polish pad into and out of engagement with the second side of the wafer.

23. The apparatus of claim 22, comprising a first fluid driven cylinder coupled to the housing and being operable to move the housing toward and away from the mandrel.

24. The apparatus of claim 22, wherein the first and second fluid chambers are in fluid communication.

25. The apparatus of claim 22, comprising a pump in fluid communication with the first and second fluid chambers for manipulating the pressure of fluid therein to move the first and second pistons.

26. The apparatus of claim 22, comprising polishing mixture dispenser having first and second nozzles for dispensing polishing mixture to the first and second sides of the wafer, and a reservoir for delivering a quantity of polishing mixture to the first and second nozzles.

27. The apparatus of claim 26, comprising a second pump coupled to the reservoir and the first and second nozzles for pumping mixture from the reservoir to the nozzles.

28. The apparatus of claim 22, wherein the first and second polish pads are composed of a ceramic material.

29. The apparatus of claim 28, wherein the ceramic material comprises aluminum oxide.

30. The apparatus of claim 22, comprising a first spring positioned in the housing to bias the first piston away from the wafer and a second spring position in the housing to bias the second piston away from the wafer.

31. An apparatus for polishing a semiconductor wafer having first and second sides and a central opening, comprising:

a mandrel for holding the wafer;

a coupling having a first half fixedly coupled to the mandrel and having a first flange with a first elastomeric member coupled to the first flange to compliantly engage the first side of the semiconductor wafer, and a second half having a second flange with a second elastomeric member coupled to the second flange to compliantly engage the second side of the semiconductor wafer;

a motor coupled to the mandrel and being operable to rotate the mandrel; and a first polisher assembly having a first arcuate polish pad for polishing the first side of the wafer and a second arcuate polish pad for polishing the second side of the wafer, and first means for moving the first and second polish pads into and out of engagement with the first and second sides of the wafer.

32. The apparatus of claim 31, wherein the first means for moving the first and second arcuate polish pads into and out of engagement with the first and second sides of the wafer comprises a first caliper assembly having a first finger having a first end coupled to the first polish pad and a second end pivotably coupled to a member, and a second finger opposable to the first finger and having a third end coupled to the second polish pad and a fourth end pivotably coupled to the member, and a first biasing member coupled to the first and second fingers to bias the first and second fingers toward each other.

33. The apparatus of claim 31, comprising a second polisher assembly having a third polish pad for polishing the first side of the wafer and a fourth polish pad for polishing the second side of the wafer, and second means for moving the first and second polish pads into and out of engagement with the first and second sides of the wafer.

34. The apparatus of claim 33, wherein each of the first and second polisher assemblies comprises a pivotable joint to enable the respective polisher assembly to be pivoted away from the mandrel to enable the wafer to be coupled to the mandrel.

35. The apparatus of claim 33, wherein the second means comprises a second caliper assembly having a third finger having a first end coupled to the third polish pad and a second end pivotably coupled to a member, and a fourth finger opposable to the third finger and having a third end coupled to the fourth polish pad and a fourth end pivotably coupled to the member, and a second biasing member coupled to the third and fourth fingers to bias the third and fourth fingers toward each other.

* * * * *

UNITED STATES PATENT AND TRADEMARK OFFICE

CERTIFICATE OF CORRECTION

PATENT NO: 6,099,387

DATED: August 8, 2000

INVENTOR(S): Mark C. Gilmer et al.

It is hereby certified that error appears in the above-identified patent and that said Letters Patent is hereby corrected as shown below:

In column 1, lines 11, 21, 24 and 58, delete "modem" and substitute --modern-- therefor;

In column 9, lines 15 & 16, delete "85B″" and substitute --85B′′′-- therefor;

In column 9, line 15, delete "85A″" and substitute --85A′′′-- therefor;

In claim 10, insert the word --holding-- between the phrase "a mandrel for" and the phrase "the wafer"; and delete the word "moves" in the last line and substitute the word --move-- therefor;

In claim 19, insert the word --a-- after the word "comprising"; and

In claim 26, insert the word --a-- after the word "comprising".

Signed and Sealed this

First Day of May, 2001

*Attest:*

Nicholas P. Godici

NICHOLAS P. GODICI

*Attesting Officer*

*Acting Director of the United States Patent and Trademark Office*